US007307596B1

(12) United States Patent
West

(10) Patent No.: US 7,307,596 B1
(45) Date of Patent: Dec. 11, 2007

(54) LOW-COST ONE-DIMENSIONAL ELECTROMAGNETIC BAND GAP WAVEGUIDE PHASE SHIFTER BASED ESA HORN ANTENNA

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 265 days.

(21) Appl. No.: 10/891,910

(22) Filed: Jul. 15, 2004

(51) Int. Cl.
*H01Q 13/00* (2006.01)

(52) U.S. Cl. ..... 343/778; 343/786

(58) Field of Classification Search ..... 343/700 MS, 343/762, 772, 778, 786; 333/157
See application file for complete search history.

(56) References Cited

U.S. PATENT DOCUMENTS

| | | | | |
|---|---|---|---|---|
| 4,198,640 | A | 4/1980 | Bowman | 343/754 |
| 4,229,745 | A * | 10/1980 | Kruger | 343/771 |
| 4,323,901 | A | 4/1982 | De Wames et al. | 343/754 |
| 5,170,140 | A | 12/1992 | Lowe et al. | 333/157 |
| 5,309,165 | A | 5/1994 | Segal et al. | 343/770 |
| 5,309,166 | A | 5/1994 | Collier et al. | 343/778 |
| 5,426,403 | A | 6/1995 | LaLau et al. | 333/238 |
| 5,481,223 | A | 1/1996 | Wong | 330/124 R |
| 5,786,792 | A | 7/1998 | Bellus et al. | 343/770 |
| 5,835,062 | A | 11/1998 | Heckaman et al. | 343/700 MS |
| 5,845,391 | A | 12/1998 | Bellus et al. | 29/600 |
| 6,285,337 | B1 | 9/2001 | West et al. | 343/853 |
| 6,384,787 | B1 | 5/2002 | Kim et al. | 343/700 MS |
| 6,429,823 | B1 | 8/2002 | Bains et al. | 343/755 |
| 6,441,787 | B1 | 8/2002 | Richards et al. | 343/700 MS |
| 6,518,930 | B2 | 2/2003 | Itoh et al. | 343/767 |
| 6,552,691 | B2 | 4/2003 | Mohuchy et al. | 343/770 |
| 6,650,291 | B1 | 11/2003 | West et al. | 342/371 |
| 6,756,866 | B1 * | 6/2004 | Higgins | 333/157 |
| 6,825,741 | B2 * | 11/2004 | Chappell et al. | 333/204 |
| 6,933,812 | B2 * | 8/2005 | Sarabandi et al. | 333/219 |
| 6,967,282 | B2 * | 11/2005 | Tonomura et al. | 174/35 R |
| 7,030,463 | B1 * | 4/2006 | Subramanyam et al. | 257/595 |

OTHER PUBLICATIONS

*Antenna Engineering Handbook*, Johnson and Jasik Eds., Chapter 9, *Slot-Array Antennas*, Hung Yuet Yee, pp. 9-1 through 9-37, McGraw-Hill, NY, NY, 1984.

*The Handbook of Antenna Design, vol. 2*, Rudge, Milne, Olver, and Knight, Chapter 10, *Planar Arrays*, R.C. Hanson, pp. 161-169, Peter Peregrinus Ltd. London, UK, 1983.

*Low Series Resistance GaAs Schottky Diode Development and GaAs Waveguide Sidewall Simulation Report*, by Xin Hao, Milestone Document for DARPA FCS Program: High Band 37-GHz Beam Forming Active Array Antenna System for Future Combat Systems Applications, Rockwell Scientific Company, Feb. 2002.

(Continued)

*Primary Examiner*—Shih-Chao Chen
(74) *Attorney, Agent, or Firm*—Nathan O. Jensen; Kyle Eppele

(57) ABSTRACT

A one-dimensional electromagnetic band gap (EBG) waveguide phase shifter electronically scanned array (ESA) horn antenna utilizes a linear array of EBG waveguide phase shifters for scanning and radiating a beam. A linear array feed feeds the linear array of EBG waveguide phase shifters. A horn directs radiation from the linear array of EBG waveguide phase shifters. Each of the EBG waveguide phase shifters is a waveguide with vertical and horizontal sidewalls. EBG devices are located on the vertical waveguide walls to shift phase to scan the beam.

20 Claims, 8 Drawing Sheets

OTHER PUBLICATIONS

"Characteristics of Ka Band Waveguide Using Electromagnetic Crystal Sidewalls", by J. A. Higgins et al., 2002 IEEE MTT-S International Microwave Symposium, Seattle, WA, Jun. 2002.

*FCS_Demo_1_Presentation_02_09_02_jbw*, by J.B. West and J.P. Doane, Final Test Report (Power Point Presentation) for Rockwell Collins work on DARPA FCS Demo-1 Beam Former Phased Scanned Lens, Feb. 9, 2002.

*Waveguide Slot Array Design*, by I. Kaminow and R. Stegen, Technical Memorandum 348, Hughes Aircraft Company, Microwave Laboratory, Research and Development Laboratories, 1954.

*C-Slot; a Practical Solution for Phased Arrays of Radiating Slots Located on the Narrow Side of Rectangular Waveguides*, by T. Sphicopoulos, Proceedings of the IEE, vol. 120 Part H, No. 2, 1982, pp. 49-55.

*Compact Resonant Slot for Waveguide Arrays*, by R.J. Chingel and J. Roberts, Proceedings of the IEE, vol. 125, No. 11, Nov. 1978, pp. 1213-1216.

*Microwave Antenna Theory and Design*, S. Silver, pp. 287-301, Peter Peregrinus Ltd, London, UK, 1984.

"The Reflectarray Antenna", by D.G. Berry et al., IEEE Transactions on Antennas and Propagation, Nov. 1963, pp. 645-651.

"High-Impedance Electromagnetic Surfaces with a Forbidden Frequency Band", by Dan Sievenpiper et al., IEEE Transactions on Microwave Theory and Techniques, vol. 47, No. 11, Nov. 1999.

"Wideband Vivaldi Arrays for Large Aperture Antennas" by D. H. Schaubert et al. Perspectives on Radio Astronomy- Technology for Large Antenna Arrays, Netherlands Foundation for Research in Astronomy, 1999.

Patent Application for "A Construction Approach for an EMXT-Based Phased Array Antenna", by John C. Mather et al., U.S. Appl. No. 10/273,872, filed Oct. 18, 2002.

Patent Application for "A Method and Structure for Phased Array Antenna Interconnect", by John C. Mather et al., U.S. Appl. No. 10/273,459, filed Oct. 18, 2002.

Patent Application for "One-Dimensional and Two-Dimensional Electronically Scanned Slotted Waveguide Antennas Using Tunable Band Gap Surfaces", by James B. West et al., U.S. Appl. No. 10/458,481, filed Jun. 10, 2003.

Patent Application for "Frequency Agile Material-Based Reflectarray Antenna", by James B. West, U.S. Appl. No. 10/354,280, filed Jan. 30, 2003.

Patent Application for "Independently Controlled Dual-Mode Analog Waveguide Phase Shifter", by James B. West et al., U.S. Appl. No. 10/698,774, filed Oct. 23, 2002.

Presentation to DARPA on Apr. 23, 2003 "EMXT Beamformer Antenna Technology Review".

Presentation to AFRL, Wright Patterson AFB, in Apr. 2001, "Millimeter Wave Antenna Technology".

Patent Application for "A Dual-Band Multibeam Waveguide Phased Array", by James B. West et al., U.S. Appl. No. 10/699,514, filed Oct. 23, 2003.

"Experimental Results on Multi-Beam Receiving Antenna for Satellite Broadcasting" NHK Laboratories Note No. 463, by M. Fujita et al., Apr. 2000.

"A Rectangular TEM Waveguide with Photonic Crystal Walls for Excitation of Quasi-Optical Amplifiers", by M. Kim et al., IEEE MTT-S International Microwave Symposium, Anaheim, CA. Jun. 1999.

* cited by examiner

LOW-COST ONE-DIMENSIONAL ELECTROMAGNETIC BAND GAP WAVEGUIDE PHASE SHIFTER BASED ESA HORN ANTENNA

CROSS REFERENCE TO RELATED APPLICATIONS

The present application is related to co-pending application Ser. No. 10/458,481 filed on Jun. 10, 2003 entitled "One-Dimensional and Two-Dimensional Electronically Scanned Slotted Waveguide Antennas Using Tunable Band Gap Surfaces"; Ser. No. 10/354,280 filed on Jan. 30, 2003 entitled "Frequency Agile Material-Based Reflectarray Antenna" invented by James B. West; Ser. No. 10/273,459 filed on Oct. 18, 2002 entitled "A Method and Structure for Phased Array Antenna Interconnect" invented by John C. Mather, Christina M. Conway, and James B. West; Ser. No. 10/273,872 entitled "A Construction Approach for an EMXT-Based Phased Array Antenna" invented by John C. Mather, Christina M. Conway, James B. West, Gary E. Lehtola, and Joel M. Wichgers; Ser. No. 10/698,774 filed on Oct. 23, 2003 entitled "Independently Controlled Dual-Mode Analog Waveguide Phase Shifter" invented by James B. West and Jonathan P. Doane; and Ser. No. 10/699,514 filed on Oct. 31, 2003 entitled "A Dual-Band Multibeam Waveguide Phased Array" invented by James B. West and Jonathan P. Doane. The co-pending applications are incorporated by reference herein in their entirety. All applications are assigned to the assignee of the present application.

BACKGROUND OF THE INVENTION

This invention relates to antennas, phased array antennas, and specifically to a one-dimensional electromagnetic band gap (EBG) waveguide phase shifter based electronically scanned array (ESA) horn antenna.

Phased array antennas offer significant system level performance enhancements for advanced communications, data link, radar, and SATCOM systems. The ability to rapidly scan the radiation pattern of the array allows the realization of multi-mode operation, LPI/LPD (low probability of intercept and detection), and A/J (antijam) capablities. One of the major challenges in phased array design is to provide a cost effective and environmentally robust interconnect and construction scheme for the phased array assembly. Additional requirements include phased array antenna phase shifting methods and techniques.

It is well known within the art that the operation of a phased array is approximated to the first order as the product of the array factor and the radiation element pattern as shown in Equation 1 for a linear array.

$$E_A(\theta) \equiv \underbrace{E_p(\theta,\phi)}_{\text{Radiation Element Pattern}} \underbrace{\left[\frac{\exp\left(-j\frac{2\pi r_o}{\lambda}\right)}{r_o}\right]}_{\text{Isotropic Element Pattern}} \cdot \underbrace{\sum_N A_n \exp\left[-j\frac{2\pi}{\lambda} n\Delta x(\sin\theta - \sin\theta_o)\right]}_{\text{Array Factor}} \qquad \text{Equation 1}$$

Standard spherical coordinates are used in Equation 1 and θ is the scan angle referenced to bore sight of the array. Introducing phase shift at all radiating elements within the array changes the argument of the array factor exponential term in Equation 1, which in turns steers the main beam from its nominal position. Phase shifters are RF devices or circuits that provide the required variation in electrical phase. Array element spacing is related to the operating wavelength and sets the scan performance of the array. All radiating element patterns are assumed to be identical for the ideal case where mutual coupling between elements does not exist. The array factor describes the performance of an array of isotropic radiators arranged in a prescribed grid for a two-dimensional rectangular array grid.

Co-pending application Ser. No. 10/273,459 effectively resolves the phased array interconnect problem by utilizing fine pitch, high-density circuitry in a thin self-shielding multi-layer printed wiring assembly. The new approach utilizes the thickness dimension of an array aperture wall (parallel to bore sight axis) to provide the surface area and volume required to implement all of the conductive traces for phase shifter bias, ground, and control lines.

A packaging, interconnect, and construction approach is disclosed in co-pending application Ser. No. 10/273,872 that creates a cost-effective EMXT (electromagnetic crystal)-based phased array antennas having multiple active radiating elements in an X-by-Y configuration. EMXT devices are also known in the art as tunable photonic band gap (PBG) and tunable electromagnetic band gap (EBG) substrates.

A detailed description of a waveguide section with tunable EBG phase shifter technologies is available in a paper by J. A. Higgins et al. "Characteristics of Ka Band Waveguide using Electromagnetic Crystal Sidewalls" 2002 IEEE MTT-S International Microwave Symposium, Seattle, Wash., June 2002. Each element is comprised of EMXT sidewalls and a conductive (metallic) floor and ceiling. Each EMXT device requires a bias voltage plus a ground connection in order to control the phase shift for each element of the antenna by modulating the sidewall impedance of the waveguide. By controlling phase shift performance of the elements, the beam of the antenna can be formed and steered.

One-dimensional electronic beam steering is adequate for many communication and radar systems, with mechanical steering providing adequate beam steering rates on the second dimension, if required. Specific bands of current interest include C- and X-band for SATCOM and meteorological, multimode, and fire control radars, Ku-band (10-12 GHz), Ka-band (20/30 GHz), and Q-band (44 GHz) for satellite communication (SATCOM) systems and 38 GHz for FCS Future Combat Systems (FCS) communications and radar. For example, the FCS ground-to-ground radar/communication function requires only rapid beam scanning in azimuth with a static fan beam in elevation. Another example is an elevation only ESA for commercial multimode weather radar. Additional examples include ground-based SATCOM on-the-move and non-fighter airborne SATCOM that do not require rapid beam agility in two dimensions.

Frequently the above-mentioned systems have extremely aggressive recurring cost requirements. One-dimensional beam scanning significantly reduces the ESA phase shifter count and beam steering computer/interconnect complexity, all which directly contribute to cost. To illustrate this complexity issue, consider the following: to a first order, a N×N, two-dimensional ESA requires $N^2$ phase shifters, each with commensurate beam steering control and interconnect requirements, where as a one-dimensional ESA of the same electrical size only requires N phase shifters, control and interconnect. For N=200, the two-dimensional ESA would require 40,000 phase shifters where as the one-dimensional ESA of the same size would require 200 phase shifters.

A need exists for a cost-effective, low-loss, robust, one-dimensional electronically scanned phased arrays with extremely fast beam steering rates.

SUMMARY OF THE INVENTION

A one-dimensional electromagnetic band gap (EBG) waveguide phase shifter electronically scanned array (ESA) horn antenna is disclosed. The horn antenna has a linear array of EBG waveguide phase shifters for scanning and radiating a beam. A linear array feed feeds the linear array of EBG waveguide phase shifters. A horn shapes radiation from the linear array of EBG waveguide phase shifters. Each of the EBG waveguide phase shifters comprises a waveguide having vertical and horizontal sidewalls. Electromagnetic band gap devices are located on the vertical waveguide walls and shift phase to scan the beam. The EBG devices comprise a dielectric substrate, a plurality of conductive strips located periodically on a surface of the dielectric substrate and a ground plane located on a surface of the dielectric substrate opposite the plurality of conductive strips. The EBG devices further comprise a plurality of reactive devices placed between the conductive strips to vary reactance between the conductive strips thereby varying a surface impedance of the EBG devices to shift the phase. The reactive devices may be varactor diodes or Schotkky diodes.

The dielectric substrate may be a ferroelectric substrate having a dielectric constant varied with a bias applied to the plurality of conductive strips to shift the phase. The dielectric substrate may be a ferromagnetic substrate having a permeability varied with a bias applied to the plurality of conductive strips to shift the phase.

In the one-dimensional electromagnetic band gap waveguide phase shifter electronically scanned array horn antenna, the linear array feed may be an edge slotted $TE_{10}$ waveguide or a slotted linear one-dimensional EBG waveguide. The horn may be a horn with open sidewalls or a pyramidal horn.

It is an object of the present invention to provide a cost-effective, low-loss, robust, one-dimensional electronically scanned phased array with fast beam steering rates.

It is an object of the present invention to minimize phase shifter count with a one-dimensional scan antenna.

It is an advantage of the present invention to utilize electromagnetic band gap phase shifters to provide high-performance analog phase shifting.

It is an advantage of the present invention to utilize a horn to set gain and beamwidth in an off-scan plane.

It is a feature of the present invention to provide a dual-mode phase shifter capability in a one-dimensional ESA horn antenna.

BRIEF DESCRIPTION OF THE DRAWINGS

The invention may be more fully understood by reading the following description of the preferred embodiments of the invention in conjunction with the appended drawings wherein.

DETAILED DESCRIPTION

The present invention is for a low-cost one-dimensional electromagnetic band gap (EBG) waveguide phase shifter based electronically scanned array (ESA) horn antenna.

Figure 1:
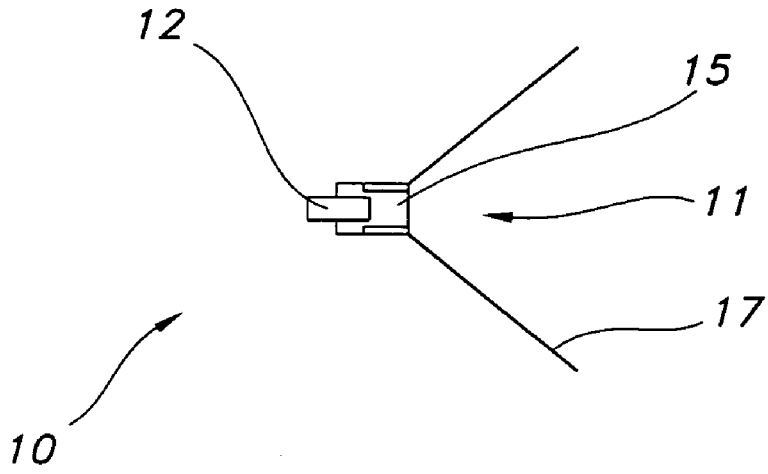
FIG. 1 illustrates a side view of a linearly polarized one-dimensional electronically scanned array (ESA) horn antenna with electromagnetic band gap (EBG) waveguide phase shifters of the present invention.
Figure 2:
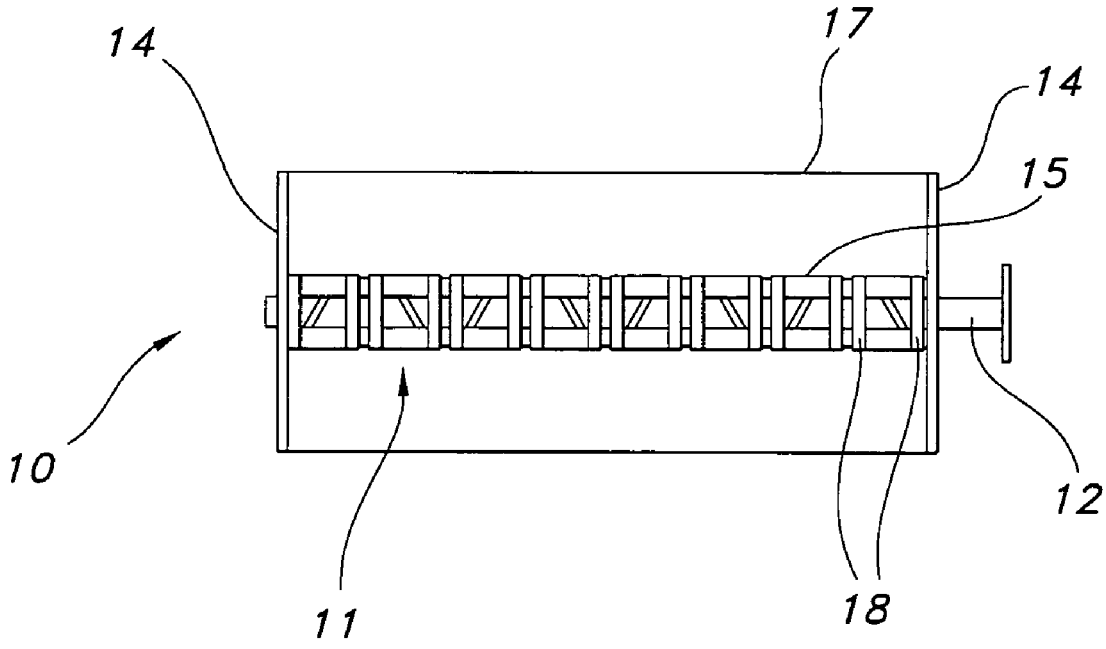
FIG. 2 is a front view of the ESA horn antenna of FIG. 1.

FIG. 1 illustrates a side view of a linearly polarized one-dimensional ESA horn antenna 10 with EBG waveguide phase shifters 15 of the present invention. A horn 17 is fed by a one-dimensional EBG waveguide phase shifting ESA linear array horn feed 11. The horn 17 may be a metallic sectoral horn. A linear array feed 12 feeds a linear array of EBG waveguide radiating elements 15 that comprise the EBG ESA feed 11. A beam is formed in the plane of the electronic scan by the linear array feed 12. The beam in the orthogonal plane is collimated by the optical characteristics of the horn 17. FIG. 2 is a front view of the horn antenna 10 of the present invention. The horn 17 may be a pyramidal horn with sidewalls 14. The pyramidal horn 17 can operate either in a $TE_{01}$ or TEM mode, depending on the boundary conditions of the sidewalls 14. If sidewalls 14 are metallic, then the horn operates in the $TE_{01}$ mode, whereas if the sidewalls 14 are resonant passive EBG, then horn 17 operates in the TEM mode. Gain is increased in the plane perpendicular to the ESA linear array with the pyramidal horn. EBG sidewalls 18 are disposed on the waveguide radiating element 15 sidewalls. The horn antenna 10 is shown in FIGS. 1 and 2 configured to scan in a horizontal plane. The horn antenna 10 can be rotated 90 degrees from the position shown to scan in a vertical plane.

The one-dimensional EBG waveguide phase shifter based ESA horn antenna 10 of the present invention can be realized with an EBG waveguide phase shifter-based linear array of several embodiments. The use of EBG waveguide phase shifters offers low-cost solutions for high performance, low loss, and high switching speeds. Another advantage of the present invention is analog phase shifting, which eliminates the quantization side lobes inherent to digital phase shifters and true time delay (TTD) devices in a plane in which an array beam is electronically scanned.

Figure 3:
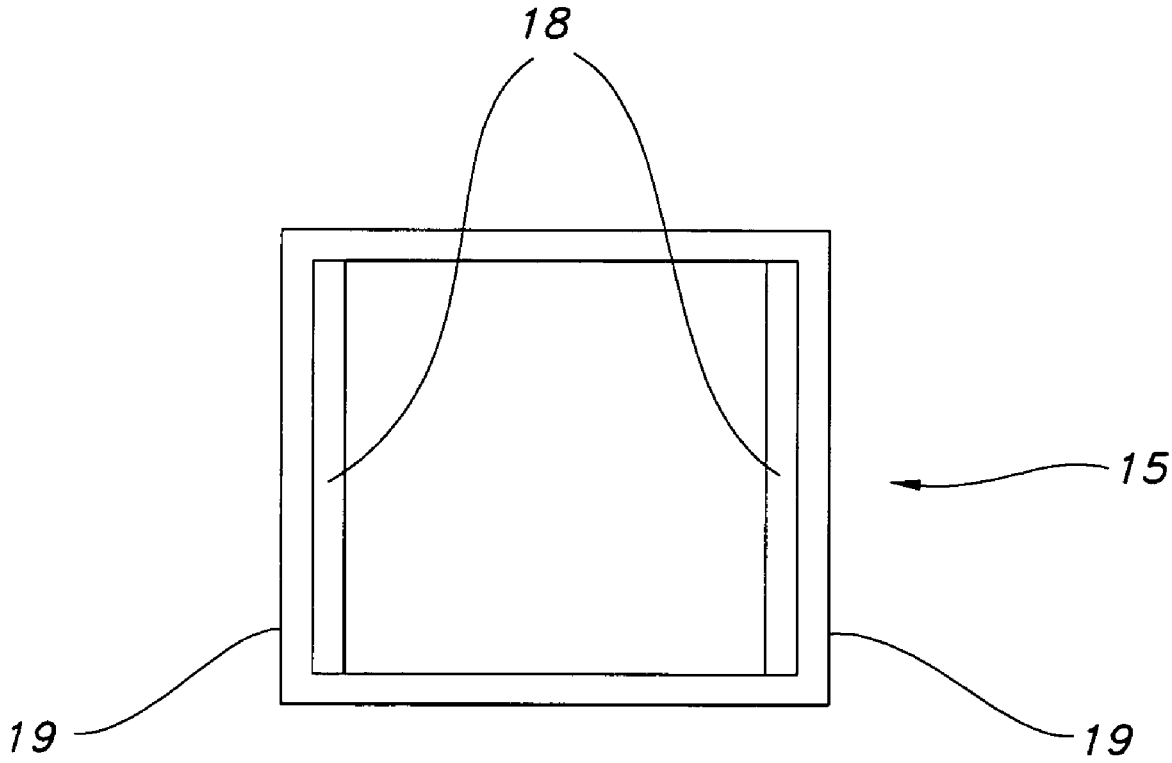
FIG. 3 shows an analog waveguide phase shifter radiating element using electromagnetic band gap devices on waveguide sidewalls.

An analog waveguide phase shifter radiating element 15 using electromagnetic band gap (EBG) devices 18 on waveguide sidewalls 19 is shown in FIG. 3. A detailed description of a waveguide section with tunable EBG phase shifter technologies is available in the referenced paper by J. A. Higgins et al. "Characteristics of Ka Band Waveguide using Electromagnetic Crystal Sidewalls". The paper describes electromagnetic crystal (EMXT) devices implemented with EBG materials. EBG devices have periodic surfaces that become a high impedance (open circuit) to incident waves at their resonant frequency. The surface impedance of a given tunable EBG physical device is a function of the tuning mechanism on the EBG and frequency. The EBG substrate material may be GaAs, ferroelectric, ferromagnetic, or any suitable EBG embodiment.

Figure 4A:
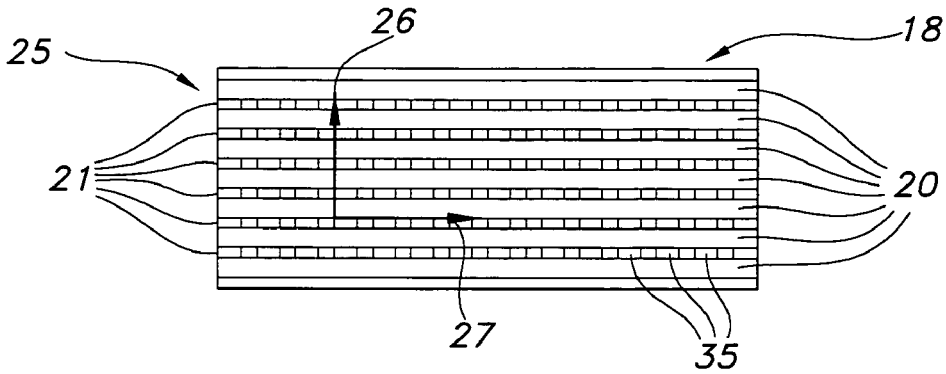
FIG. 4*a* is a top view of an electromagnetic band gap device sidewall used in the waveguide phase shifter of FIG. 3.
Figure 4B:
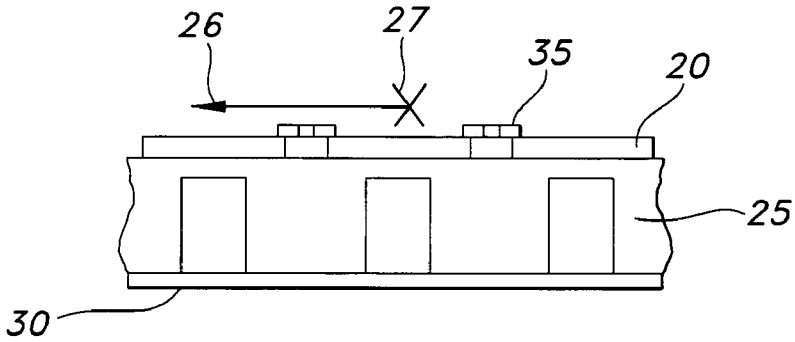
FIG. 4*b* is a physical cross section view of the electromagnetic band gap device of FIG. 4*a;*
Figure 4C:
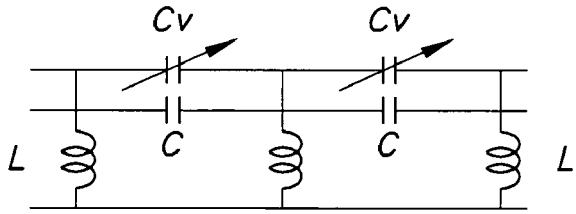
FIG. 4*c* is an electrical circuit representation of the electromagnetic band gap device of FIGS. 4*a* and 4*b;*
Figure 5:
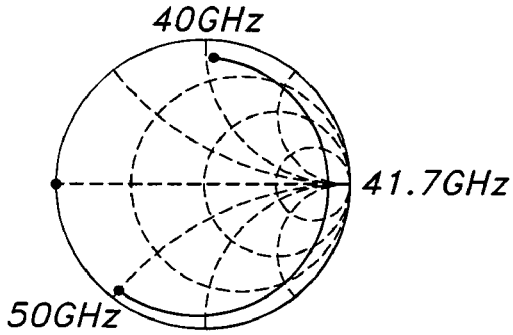
FIG. 5 is a Smith chart showing high impedance at resonance of the electromagnetic band gap devices.

The waveguide sidewalls 19 of the EBG waveguide phase shifter 15 each contain an EBG device 18 that consists of a periodic surface of conductive strips 20 that may be metal separated by gaps 21 over a surface of a dielectric substrate 25 as shown in FIG. 4*a* and FIG. 4*b*. These strips 20 capacitively couple to each other and inductively couple to a ground plane 30 on an opposite surface of the substrate 25 as shown in FIG. 4*b*. This structure creates a LC tank circuit shown in FIG. 4*c* that resonates at a desired frequency. Near the desired resonant frequency, the EBG device 18 surface behaves like a high impedance to a wave traveling down the waveguide as shown in FIGS. 4*a* and 4*b*, thus allowing a tangential electric field. Since the high impedance also limits current flow, the tangential magnetic field is forced to zero. The fundamental mode of such a structure is therefore TEM (transverse electromagnetic) having a uniform vertical electric field shown by arrow 26 and a uniform horizontal magnetic field (not shown), both transverse to the direction of propagation shown by arrow 27 in FIG. 4*b*.

Various methods of tuning the EBG device 18 exist. The most developed is a plurality of reactive devices 35 such as varactor diodes or Schotkky diodes placed periodically between the strips 20 to vary a reactance. By adjusting a reverse bias voltage on the diodes 35 applied via the conductive metallic strips 20 from a control source (not shown), the capacitive coupling between the strips 20 is varied as shown by a variable capacitor Cv in FIG. 4*c*, and the overall surface impedance of the EBG device 18 shifts. With a shift in the surface impedance of the EBG devices 18 on the waveguide sidewalls 19, the propagation velocity of the wave is also modulated. The insertion phase of the element can therefore be actively controlled, resulting in a 360° analog phase shifter, for a sufficiently long element.

The tunable EBG device 18 may be implemented in semiconductor MMIC (monolithic microwave integrated circuit) technology. Gallium arsenide (GaAs) and indium phosphide (InP) semiconductor substrates 25 are currently practical, but other III-V and semiconductor compounds are feasible. In these implementations the semiconductor substrate 25 acts as a passive (non-tunable) dielectric material, and tunability is obtained with the reactive devices 35 such as the varactor or Schotkky diodes in FIG. 4*b* connected across the conductive strips 20. The semiconductor device tuning elements, the top side metal geometries and the back side bias control signal line interconnections are all realized by means of commonly know semiconductor fabrication techniques.

Other types of discrete tuning elements are also possible. One example is ferroelectric tunable chip capacitors that can be attached to passive microwave/millimeter wave printed wiring board substrates.

Ferroelectric and ferromagnetic tunable EBG substrates may be used in the EBG device 18 as the dielectric substrate 25 of FIGS. 4*a* and 4*b*. Here the dielectric constant and the permeability are varied with a bias applied to the conductive strips 20 to tune the EBG device 18. Metal deposition techniques are used to form the required top-side metallic geometries and back side bias control signal line interconnections.

Ferroelectric and ferromagnetic materials are known to exhibit electrical parameters of relative permittivity and/or permeability that can be altered or tuned by means of an external stimulus such as a DC bias field. It should be noted, however, that the concepts described herein are equally applicable to any materials that exhibit similar electrical material parameter modulation by means of an external stimulus signal.

Substrates with adjustable material parameters, such as ferroelectric or ferromagnetic materials can be fabricated monolithically, i.e. in a continuous planar substrate without segmentation or subassemblies, through thin film deposition, ceramic fabrication techniques, or semiconductor wafer bulk crystal growth techniques. An example of bulk crystal growth is the Czochralski crystal pulling technique that is known within the art to grow germanium, silicon and a wide range of compound semiconductors, oxides, metals, and halides.

An advantage of using a TEM mode waveguide is that there is no cutoff frequency. In standard $TE_{10}$ mode waveguide (all metal walls), the sidewall-to-sidewall dimension must be greater than $\lambda g/2$ (one half of a waveguide wavelength). With a TEM mode waveguide, the dimensions are theoretically waveguide cross section independent, and the waveguide can be whatever size is convenient for the application. An application where this is a large advantage is in an open-ended waveguide phased array, where elements must be placed at $\lambda/2$ spacing to avoid grating lobes. Air-filled TEM elements can therefore be used where air-filled $TE_{10}$ waveguide elements can not.

Figure 6:
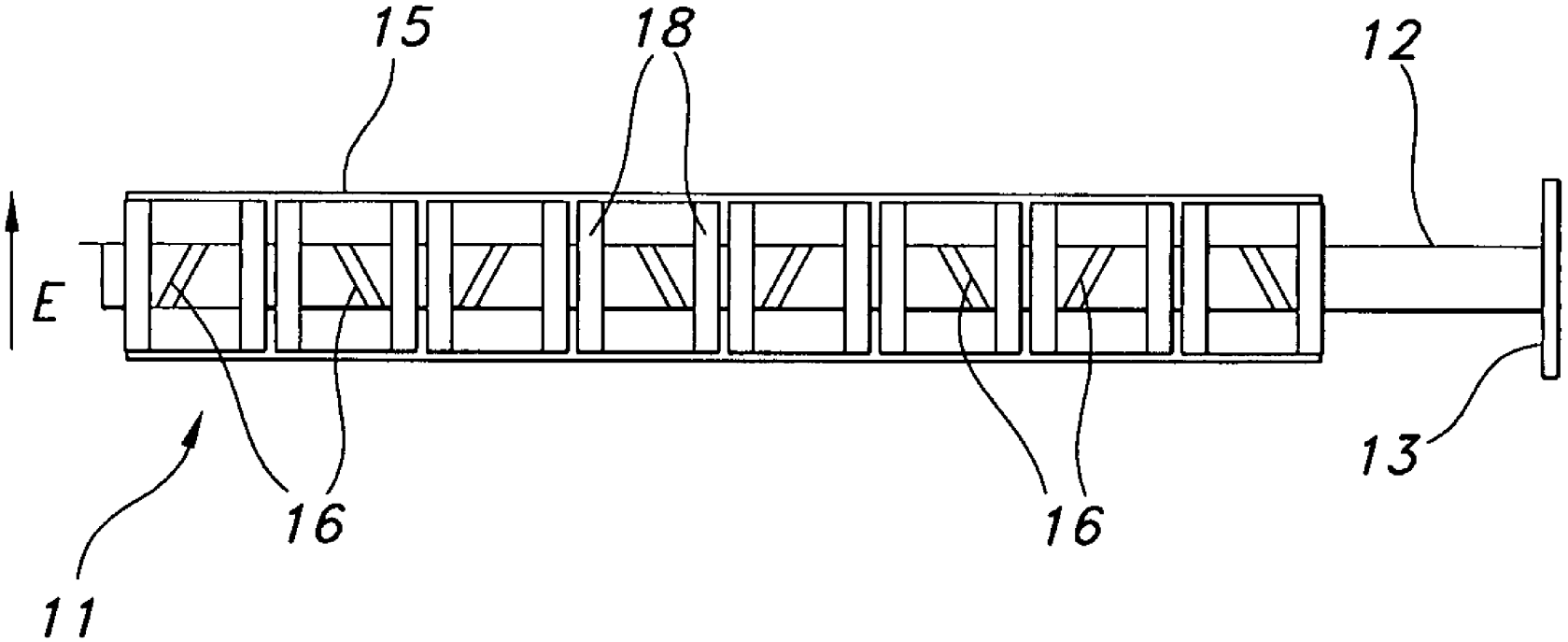
FIG. 6 is a front view of an embodiment of the EBG ESA waveguide phase shifting linear array horn feed.
Figure 7:
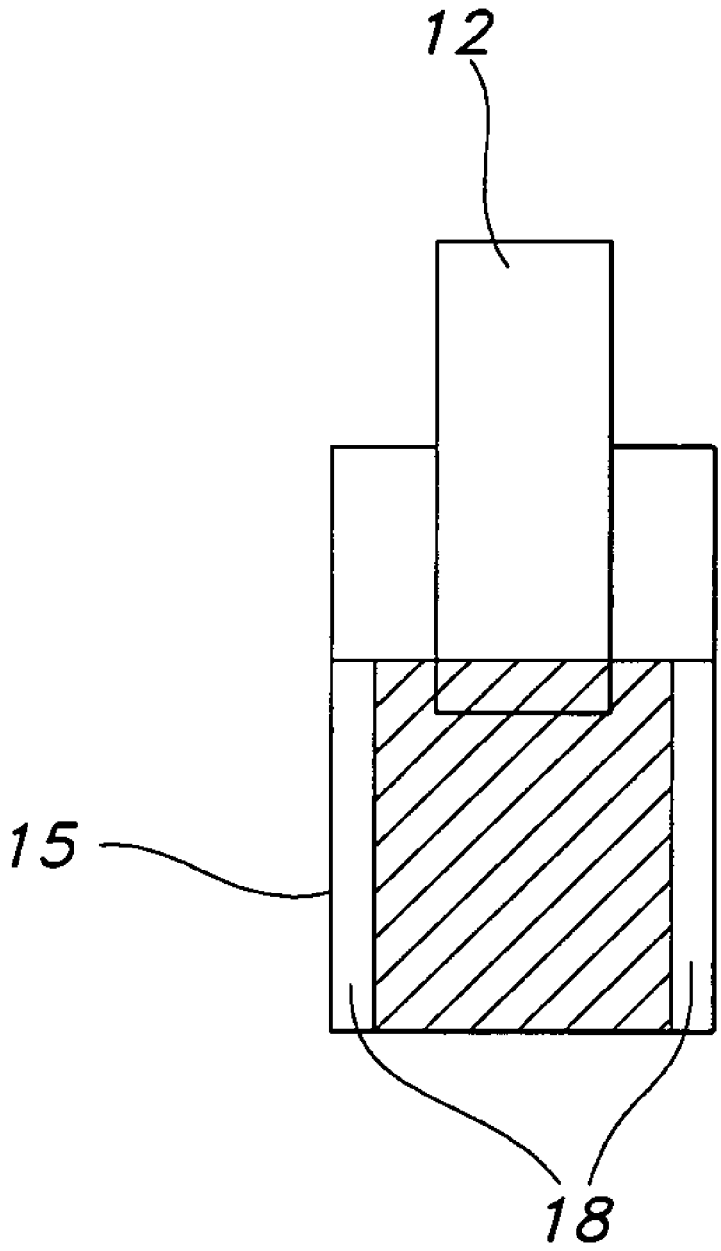
FIG. 7 is a top view of a single EBG waveguide element showing the EBG sidewalls and the feed.

An embodiment of the EBG ESA waveguide phase shifting linear array horn feed 11 of FIG. 1 is further illustrated in FIG. 6. FIG. 6 is a front view of the EBG ESA feed 11 showing an edge-slotted $TE_{10}$ waveguide as the linear array feed 12 to the EBG ESA feed 11. Only portions of the feed 12 are shown. The edge-slotted $TE_{10}$ waveguide feed 12 feeds the EBG ESA feed 11 through slots 16. It may be possible to use other types of $TE_{01}$ coupling that are commonly known in the art such as C slots, I slots, and others. FIG. 7 is a top view of a single EBG waveguide element 15 showing the EBG sidewalls 18 and the feed 12. The feed 12 can either be fed from the center or fed from the end with an input flange 13. The EBG ESA feed 11 shown is configured in a linear, vertical polarization (VP) implementation, but a linear horizontal polarization (HP) implementation is also possible by placing the EBG sidewalls 18 on the top and bottom waveguide walls, rather than on the sidewalls, as shown in the figures.

Figure 8:
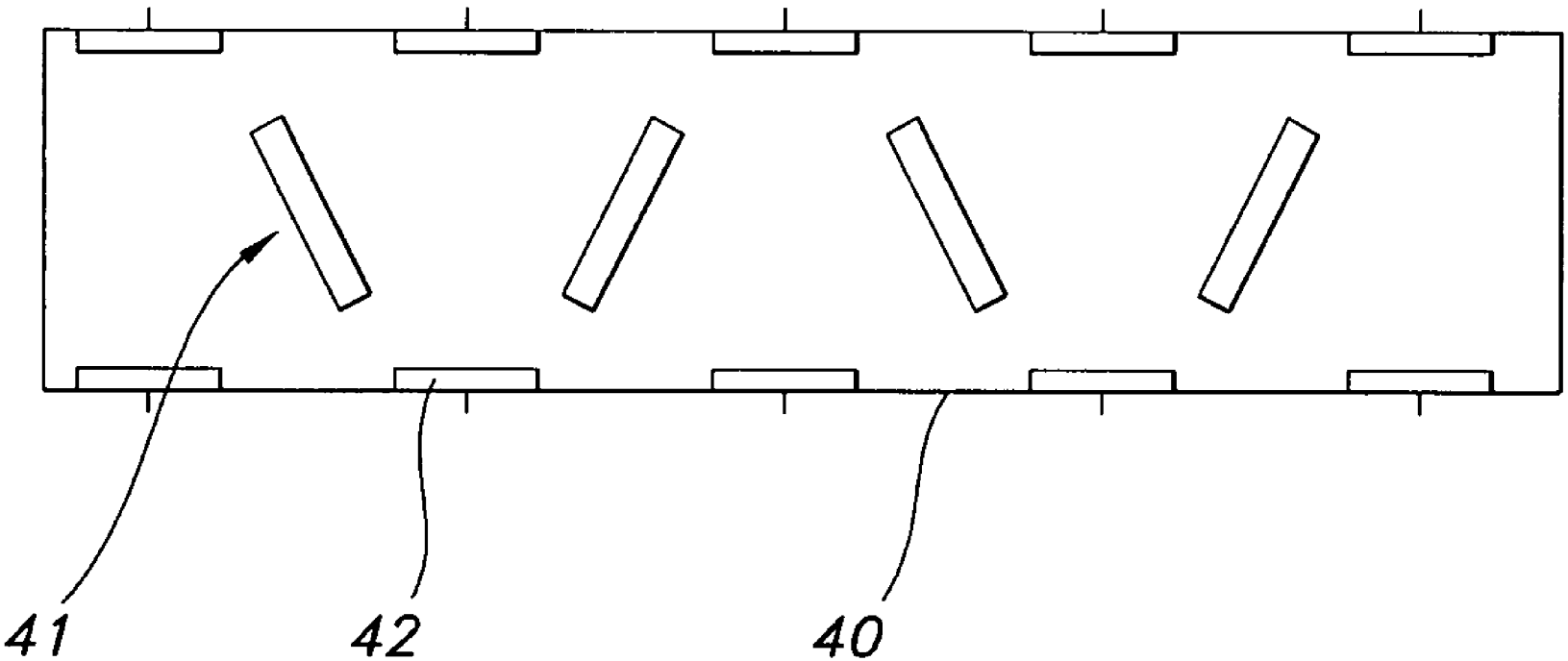
FIG. 8 illustrates a slotted linear one-dimensional EBG waveguide feed where the narrow walls of the waveguide are lined with either discrete or continuous EBG materials.

Another linear polarization feed embodiment to feed the EBG ESA feed 11 is to use an EBG linear array described in co-pending patent application Ser. No. 10/458,481 as the feed 12. This feed architecture is a slotted linear one-dimensional EBG waveguide 40 where the narrow walls of the waveguide are lined with either discrete or continuous EBG materials 42, as illustrated in FIG. 8. All one-dimensional horn embodiments, as described herein, are applicable to this architecture.

Circular polarization (CP), either right hand (RHCP) or left hand (LHCP) is also possible by using a polarizing grid, such as a meander line polarizer that is commonly known in the art, in front of the ESA horn antenna 10 aperture of FIGS. 1 and 2.

Figure 9:
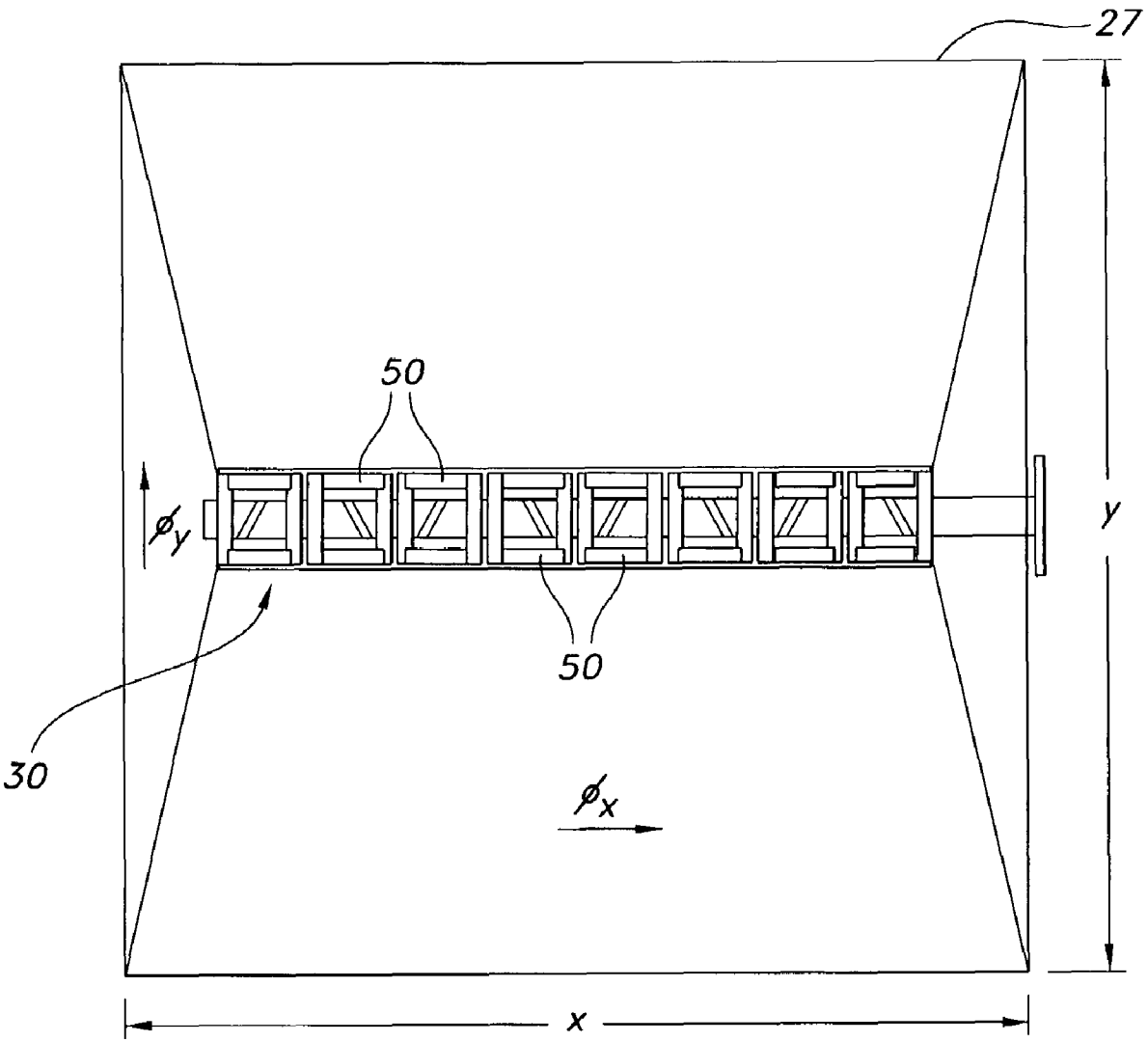
FIG. 9 illustrates a dual-mode/dual-band linear ESA used for the horn feed with a square pyramidal horn.

Another embodiment for achieving circular polarization is to feed a square pyramidal horn shown 27 in FIG. 9 with a dual-mode EBG waveguide phase shifter linear ESA feed 30. Circular polarization is possible when dimension x equals dimension y and $ø_x - ø_y \pm 90°$ at the x/y aperture plane. This implementation requires $ø_y$ to be further offset from $ø_x$ to account for the differences in vertical and horizontal horn flares due to the length of the feed 30 not being equal to the width. This additional phase offset is possible with a fixed phase shift in the non-scanning plane. One embodiment would be to put passive EBG material on the waveguide walls in the non-scan plane.

Figure 10:
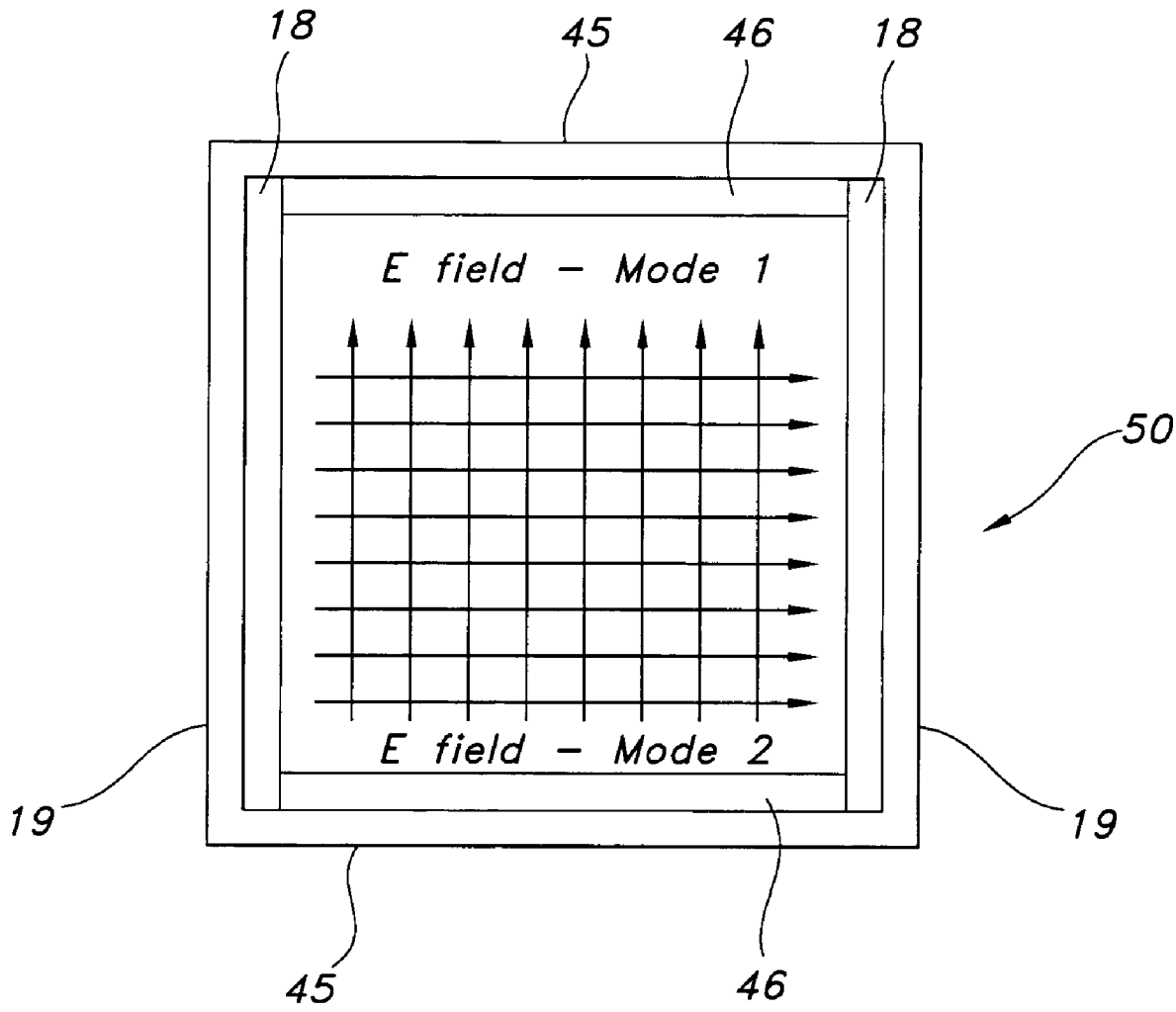
FIG. 10 shows a dual-mode EBG phase shifter that may be utilized in the present invention.

The dual-mode EBG waveguide phase shifter linear ESA feed 30 in FIG. 9 is made up of dual-mode phase shifters 50. A dual-mode phase shifter 50, conceptually illustrated in FIG. 10, is described in detail in co-pending patent application Ser. Nos. 10/698,774 and 10/699,514. By integrating EBG devices 46 into the top and bottom horizontal surfaces 45 of the waveguide as well as the sidewalls 19, a dual-mode analog phase shifter 50 may be constructed as shown in FIG. 10. This allows a second TEM mode to be supported, orthogonal to the first as shown in FIG. 10. This second TEM mode can operate on or near the same frequency in a frequency band or a different frequency band than the first mode. The insertion phase of the second mode is governed by the top and bottom EBG devices 46 on waveguide horizontal surfaces 45, while the original TEM mode is independently controlled by the EBG devices 18 on the vertical sidewall surfaces 19. Each beam can be independently steered in this configuration. In this embodiment, the four-sided pyramidal horn is used to generate independently steered ESA beams, with orthogonal linear polarization and operating in different frequency bands. Orthogonal circular polarization is possible by means of an external polarizer grid, as described in co-pending application Ser. No. 10/699,514.

Numerous other linear array feed structures 12 to excite the EBG waveguide phase shifters 15 are possible, including rectangular waveguide feeds with slots in the broad wall, single ridge waveguide with slots in either the broad or narrow walls, double-ridged waveguide with end wall coupling slots, and printed feeds such as microstrip, stripline, suspended stripline, coplanar waveguide, fine line, and others commonly know in the art.

The one-dimensional EBG waveguide phase shifter based ESA horn antenna 10 of the present invention utilizes the horn 17 to realize increased directivity and a narrower beam with in the non-scanning plane, as previously shown in FIGS. 1 and 2. The horn 17 sidewalls 14 can be metallic, which forces a $TE_{01}$ at the aperture resulting in −18 dB sidelobes in the scan plane. Alternatively, the sidewalls 14 can be removed, or open, which allows a uniform aperture distribution due to the EBG linear array resulting in a −12.5 dB sidelobe level with an optimal minimum beamwidth for a given aperture size. The radiation pattern performance of horns with these types of boundary conditions is commonly known within the art. In addition, a passive EBG surface or a tunable EBG surface can be used to provide some level of beamwidth and sidelobe level adjustment capability.

The one-dimensional EBG waveguide phase shifter based ESA horn antenna 10 can be orientated to scan either in azimuth or elevation, as dictated by the orientation of the feed manifold 11. VP, HP, RCHP, or LHCP can be realized for either scan plane, as described in the previous discussion on the feed 11.

The horn 17 dimensions determine the radiation pattern characteristics of the non-scanned plane. It is also possible to mechanically steer this ESA horn antenna 10 in the non-electronically scanned plane.

It is believed that the one-dimensional EBG waveguide phase shifter based ESA horn antenna of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A one-dimensional electromagnetic band gap (EBG) waveguide phase shifter electronically scanned array (ESA) horn antenna comprising:

a linear array of EBG waveguide phase shifters for scanning and radiating a beam;

a linear array feed to feed the linear array of ERG waveguide phase shifters; and a horn for shaping radiation from the linear array of EBG waveguide phase shifters.

2. The one-dimensional electromagnetic band gap (EBG) waveguide phase shifter electronically scanned array (ESA) horn antenna of claim 1 wherein each of the EBG waveguide phase shifters comprises:

a waveguide having vertical and horizontal sidewalls; and

EBG devices on the vertical waveguide walls or the horizontal sidewalls wherein the EBG devices on the vertical walls shift phase to scan the beam with a vertical polarization and wherein the EBG devices on the horizontal walls shift phase to scan the beam with a horizontal polarization.

3. The one-dimensional electromagnetic band gap (EBG) waveguide phase shifter electronically scanned array (ESA) horn antenna of claim 2 wherein each of the EBG devices comprise:

a dielectric substrate;

a plurality of conductive strips located periodically on a surface of the dielectric substrate; and a ground plane located on a surface of the dielectric substrate opposite the plurality of conductive strips.

4. The one-dimensional electromagnetic band gap (EBG) waveguide phase shifter electronically scanned array (ESA) horn antenna of claim 3 wherein each of the EBG devices further comprise a plurality of reactive devices placed between the conductive strips to vary reactance between the conductive strips thereby varying a surface impedance of the EBG devices to shift a phase.

5. The one-dimensional electromagnetic band gap (EBG) waveguide phase shifter electronically scanned array (ESA) horn antenna of claim 4 wherein the plurality of reactive devices comprises one of varactor diodes, Schotkky diodes, and ferroelectric chip capacitors.

6. The one-dimensional electromagnetic band gap (EBG) waveguide phase shifter electronically scanned array (ESA) horn antenna of claim 3 wherein the dielectric substrate is a ferroelectric substrate having a dielectric constant varied with a bias applied to the plurality of conductive strips to shift a phase.

7. The one-dimensional electromagnetic band gap (EBG) waveguide phase shifter electronically scanned array (ESA) horn antenna of claim 3 wherein the dielectric substrate is a ferromagnetic substrate having a permeability varied with a bias applied to the plurality of conductive strips to shift a phase.

8. The one-dimensional electromagnetic band gap (EBG) waveguide phase shifter electronically scanned array (ESA)

horn antenna of claim 1 wherein the linear array feed comprises an edge slotted TE10 waveguide.

9. The one-dimensional electromagnetic band gap (EBG) waveguide phase shifter electronically scanned array (ESA) horn antenna of claim 1 wherein the linear array feed comprises a slotted linear one-dimensional EBG waveguide.

10. The one-dimensional electromagnetic band gap (EBG) waveguide phase shifter electronically scanned array (ESA) horn antenna of claim 1 wherein the horn comprises one of a horn with open sidewalls and a pyramidal horn.

11. A one-dimensional electromagnetic band gap (EBG) waveguide phase shifter electronically scanned array (ESA) horn antenna for scanning and radiating a beam comprising:

the horn for shaping the scanned and radiated beam a one-dimensional ESA EBG waveguide phase shifting linear array horn feed for feeding the horn the scanned and radiated beam wherein the one-dimensional ESA EBG waveguide phase shifting linear array horn feed comprises a linear array of EBG waveguide radiating elements; and a linear array feed for feeding the one-dimensional ESA EBG waveguide phase shifting linear array horn feed.

12. The one-dimensional electromagnetic band gap (EBG) waveguide phase shifter electronically scanned array (ESA) horn antenna of claim 11 wherein the EBG waveguide radiating elements each comprise:

a waveguide having vertical and horizontal sidewalls; and

EBG devices on the vertical sidewalls or the horizontal sidewalls wherein the EBG devices on the vertical sidewalls shift phase to scan the beam with a vertical polarization and wherein the EBG devices on the horizontal sidewalls shift phase to scan the beam with a horizontal polarization.

13. The one-dimensional electromagnetic band gap (EBG) waveguide phase shifter electronically scanned array (ESA) horn antenna of claim 11 wherein the EBG waveguide radiating elements each comprise:

a waveguide having vertical and horizontal sidewalls; and

EBG devices on the vertical sidewalls and the horizontal sidewalls wherein the EBG devices shift phase to scan the beam.

14. The one-dimensional electromagnetic band gap (EBG) waveguide phase shifter electronically scanned array (ESA) horn antenna of claim 13 wherein the EBG devices each comprise:

a dielectric substrate;

a plurality of conductive strips located periodically on a surface of the dielectric substrate; and a ground plane located on an opposite surface from the conductive strips on the dielectric substrate.

15. The one-dimensional electromagnetic band gap (EBG) waveguide phase shifter electronically scanned array (ESA) horn antenna of claim 14 wherein the EBG devices each further comprise a plurality of reactive devices periodically placed between the conductive strips to alter capacitive coupling between the conductive strips thereby varying a surface impedance to shift a phase.

16. The one-dimensional electromagnetic band gap (EBG) waveguide phase shifter electronically scanned array (ESA) horn antenna of claim 15 wherein the plurality of reactive devices comprises one of varactor diodes, Schotkky diodes, and ferroelectric chip capacitors.

17. The one-dimensional electromagnetic band gap (EBG) waveguide phase shifter electronically scanned array (ESA) horn antenna of claim 13 wherein the EBG devices on the vertical walls phase shift in a first mode and the EBG devices on the horizontal walls phase shift in a second mode independent of the phase shift in the first mode.

18. The one-dimensional electromagnetic band gap (EBG) waveguide phase shifter electronically scanned array (ESA) horn antenna of claim 17 wherein the first mode is at a first frequency and the second mode is at a second frequency.

19. The one-dimensional electromagnetic band gap (EBG) waveguide phase shifter electronically scanned array (ESA) horn antenna of claim 17 wherein the first mode and the second mode are at a same frequency.

20. A one-dimensional electromagnetic band gap (EBG) waveguide phase shifter electronically scanned array (ESA) horn antenna comprising a linear array of EBG waveguide phase shifters for scanning and radiating a beam; a linear array feed to feed the linear array of EBG waveguide phase shifters; and a horn for directing radiation from the linear array of EBG waveguide phase shifters wherein each of the EBG waveguide phase shifters comprises:

a waveguide having vertical and horizontal sidewalls; and

EBG devices on the vertical sidewalls wherein the EBG devices on the vertical sidewalls phase shift to scan the beam said EBG devices each comprise:

a dielectric substrate;

a plurality of conductive strips periodically located on a surface of the dielectric substrate;

a ground plane located on a surface of the dielectric substrate opposite the plurality of conductive strips; and a plurality of reactive devices placed between the conductive strips to vary reactance between the conductive strips thereby varying a surface impedance of the EBG devices to shift a phase.

* * * * *